US006413322B1

(12) United States Patent
Kopaskie

(10) Patent No.: US 6,413,322 B1
(45) Date of Patent: Jul. 2, 2002

(54) MACHINE FOR VAPOR DEGREASING AND PROCESS FOR DOING SAME USING AN INFLAMMABLE FLUID

(76) Inventor: Bernard E Kopaskie, 20290 Lorencita, Covina, CA (US) 91724

( * ) Notice: Subject to any disclaimer, the term of this patent is extended or adjusted under 35 U.S.C. 154(b) by 2 days.

(21) Appl. No.: 09/627,834

(22) Filed: Jul. 28, 2000

(51) Int. Cl.[7] ..... B08B 7/04

(52) U.S. Cl. ..... 134/21; 134/30; 134/35; 134/36; 134/37; 134/40; 134/105; 202/170

(58) Field of Search ..... 134/21, 30, 31, 134/35, 36, 37, 40, 105; 202/170

(56) References Cited

U.S. PATENT DOCUMENTS 5,344,493 A * 9/1994 Jackson ..... 134/1

* cited by examiner

*Primary Examiner*—Philip Coe

(57) ABSTRACT

A machine for vapor degreasing with a atmosphere tight container for the process to take place, an inert gas purge to reduce the oxygen in the container, and a heat source to vaporize the decreasing fluid.

1 Claim, 4 Drawing Sheets

MACHINE FOR VAPOR DEGREASING AND PROCESS FOR DOING SAME USING AN INFLAMMABLE FLUID

BACKGROUND OF THE INVENTION

This invention relates generally to the field of metal processing, and more particularly to a machine for vapor degreasing and process for doing same using an inflammable fluid. The inert atmosphere allows many different chemicals to be used for the process.

Vapor degreasing has been used for years to clean parts. The degreasing fluid boils and the vapor condenses out on the parts as pure or almost pure cleaning fluid the parts are continiusly bathed in the pure fluid until they reach the fluid boiling temperature. At this temperature the parts are dry and can be removed from the degreaser clean. There are many kinds of hydrocarbon solvents that have been used for the cleaning.

There are many fluids that have and still are used for the cleaning by vapor degreasing. In the beginning the fluids were pure materials. However as problems arose there were combinations of materials used to miminize the problems. In some cases there were no subsitute materials and the problems materials had to be used. When the vapor degreasing fluids were banded many of these cleaners were replaced by aquious cleaners.

The non atmosphere tight degreasers allow vapor to excape to the atmosphere surrounding the machine. This exposed the worker and the environment to the hazardous materials used. Many were known carcinogens. Varoius nonflammable fluids and mixtures or fluids were used with mixed results. Some mixtures were difficult to control to prevent attack to the materials being cleaned. Others did not work as well as the older fluids they replaced. Various elaborate machines were developed to prevent the vapors from escaping from the machine. There were vacuum chambers and other atmosphere tight chambers used to contain the vapors. This apparatus was not used to allow the used of flammable materials but to keep the vapors contained. The aquious cleaners did not do as good a job and they generate a lot of containmented fluids.

SUMMARY OF THE INVENTION

The primary object of the invention is to use environmentally friendly fluids such as acetone.

Another object of the invention is use non ozone depleating fluids.

Another object of the invention is use fluids that are not carcingens.

A further object of the invention is use biodegradable fluids.

Yet another object of the invention is allow low temperature vapor degreasing of temperature sensitive materials.

Still yet another object of the invention is allow a large number of inflammable fluids to be used safetly.

Another object of the invention is allow the use of higher temperature vapor degreasing.

Another object of the invention is use an EPA non hazardious material.

A further object of the invention is use a fluid that will not polute the water ways.

Yet another object of the invention is using acetone allows the cleaning of titanium by vapor degreasing.

Other objects and advantages of the present invention will become apparent from the following descriptions, taken in connection with the accompanying drawings, wherein, by way of illustration and example, an embodiment of the present invention is disclosed.

A machine for vapor degreasing comprising: an atmosphere tight container for the process to take place, an inert gas purge to reduce the oxygen in the container, and a heat source to vaporize the degreasing fluid.

A process for vapor degreasing comprising the steps of: a atmosphere tight container for the process to take place, an inert As purge to reduce the oxygen in the container, and a heat source to vaporize the degreasing fluid.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
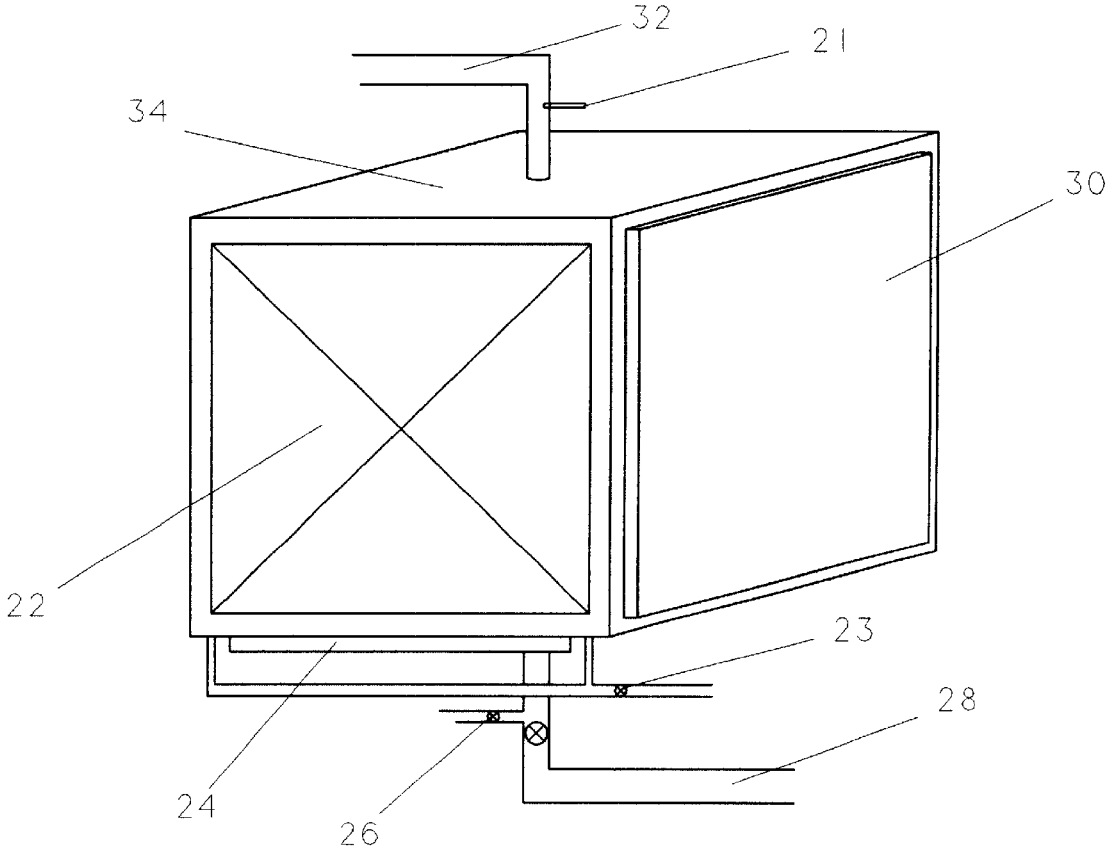
FIG. 1 is an isometric drawing showing the major components if the vapor degreasing unit.

Turning to FIG. 1 there it shows the isometric drawing of the invention. The machine comprising an atmosphere tight container 34, that has an air tight door 22. There are several openings in the chamber to input fluids 23, taking out fluids 28, and removing vapors 32. There is also an opening 26, to input the purge gas. The thermocouple 21, will signal the end of the cycle. There are heat exchangers to heat the cleaning fluid to vaporize it 24. There is also a heat exchanger to take the heat out of the chamber to start the next cycle 30.

Figure 2:
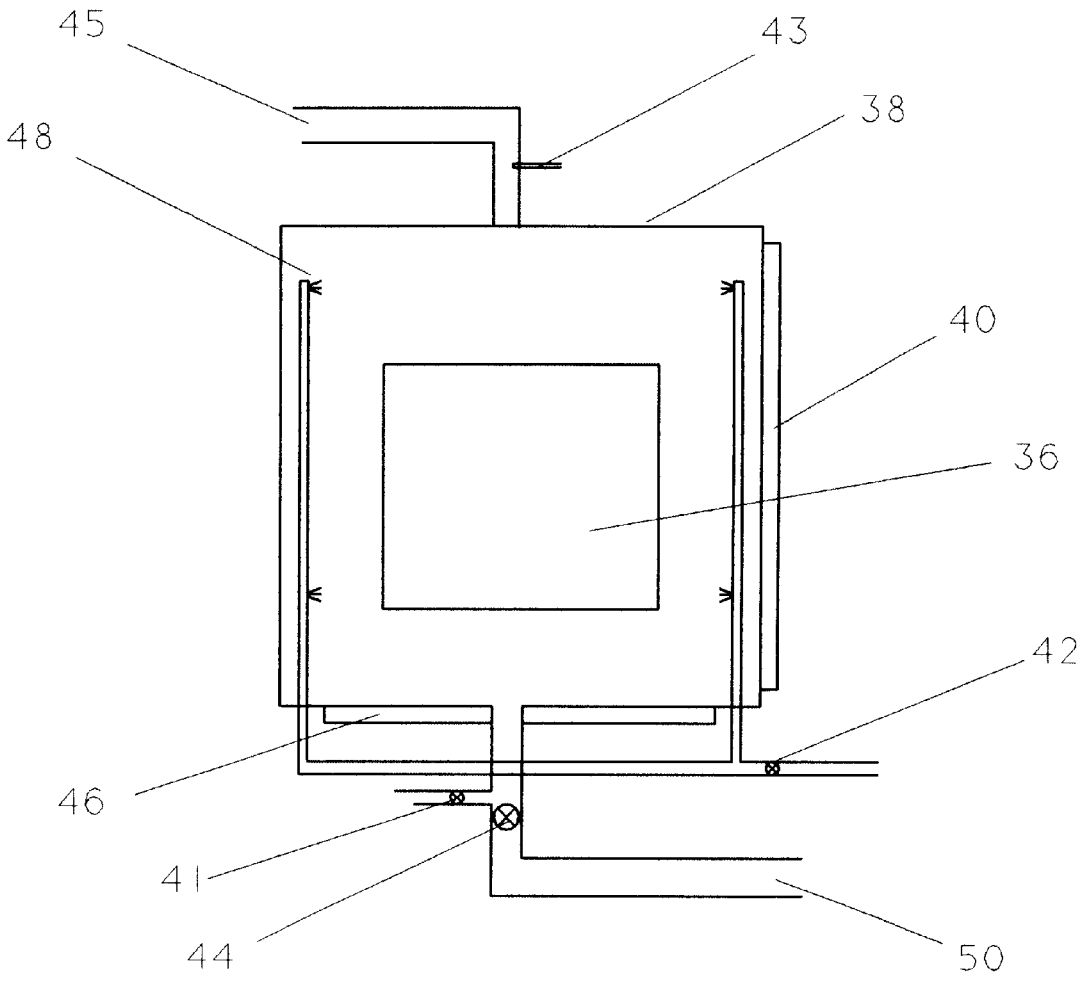
FIG. 2 is a longitudinal section through the vapor degreasing unit showing the work location, spray nozzles, as well as other major components of the unit.

Turning to FIG. 2 shows a section through the invention. The sequence of events, the necessary steps, of a typical process taking place would be as described. The parts would be loaded in the invention and the door sealed. The inert valve 41 would be opened and the chamber purged to reduce the oxygen level in the chamber. The gas exiting to the vapor recovery system through pipe 45. Valve 41 would then be closed and valve 42 would be opened and the degreasing fluid would be sprayed into the chamber through the nozzles 48, over the work to be cleaned 36. Valve 44 would be open and the fluid returned to be reclaimed. Before the spray is turned off valve 44 is closed trapping some fluid. The spray is stopped and valve 42 is closed. A liquid hot enough to boil the degreasing fluid is pumped into heat exchanger 46. The fluid trapped in the bottom of the chamber is boiled. The vapor would rise and surrounding the work. It would condense on the work washing the work with pure degreasing fluid. This vaporized fluid heats the work as it condenses on the work. When the work reaches the temperature of the boiling vapor, the vapor will rise to heat the thermocouple 43 to signal the end of the cycle. The hot fluid will be stopped and drained from the heat exchanger 46. Valve 44 will open and drain the hot cleaning fluid from the chamber. The inert gas valve 41 will open valve 44 will close and the chamber will be purged of vapor through the exit 45 to the vapor recovery system. The work can now be removed from the chamber. Heat exchanger 40 is now filled with cool liquid to cool the chamber for the next cleaning cycle.

The fluid that is sprayed over the parts through valve 42 and nozzles 48 may be cool cool the work. This increase the difference in temperature between the work and the boiling point of the degreasing fluid allowing a longer degreasing cycle for better cleaning.

Figure 3:
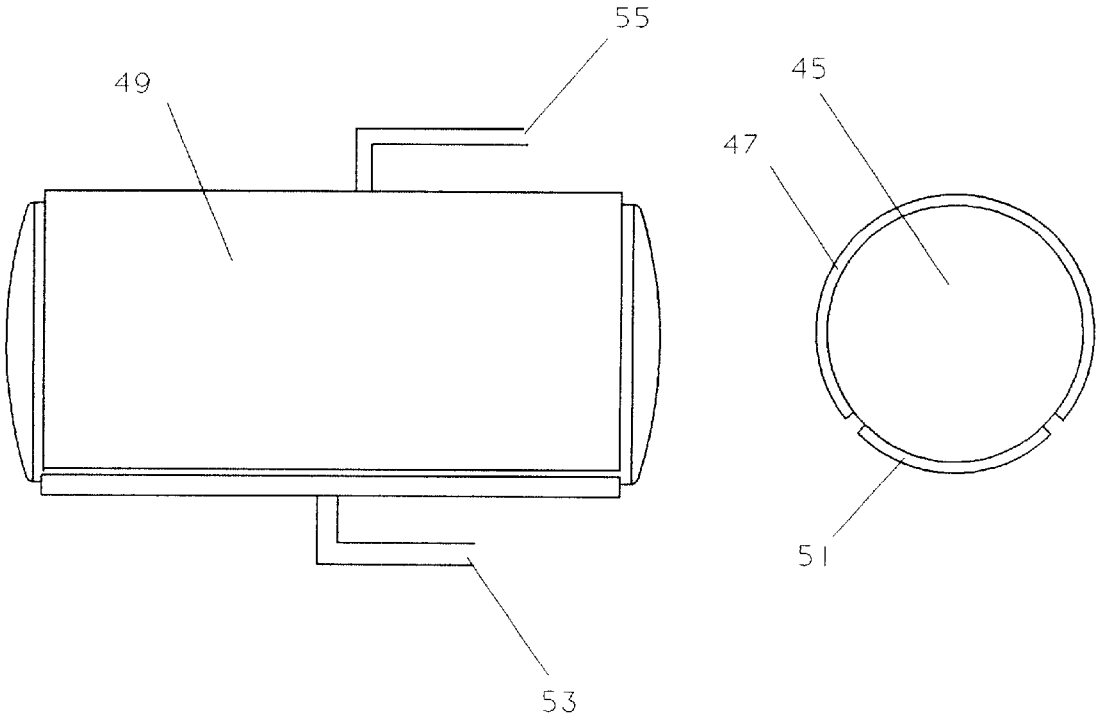
FIG. 3 is an end and side view of a vacuum unit. The unit may be used as a vacuum purge unit or as a unit to vapor degrease at pressure below atmosphere.

FIG. 3 shows an alternate method of the invention. This chamber 47 may be a vacuum or pressure chamber. This alternate is a round chamber with a vacuum/pressure door 45 heat exchangers 51 and 49 for heating and cooling. There are also opening to allow input and removal of fluids and gases.

Figure 4:
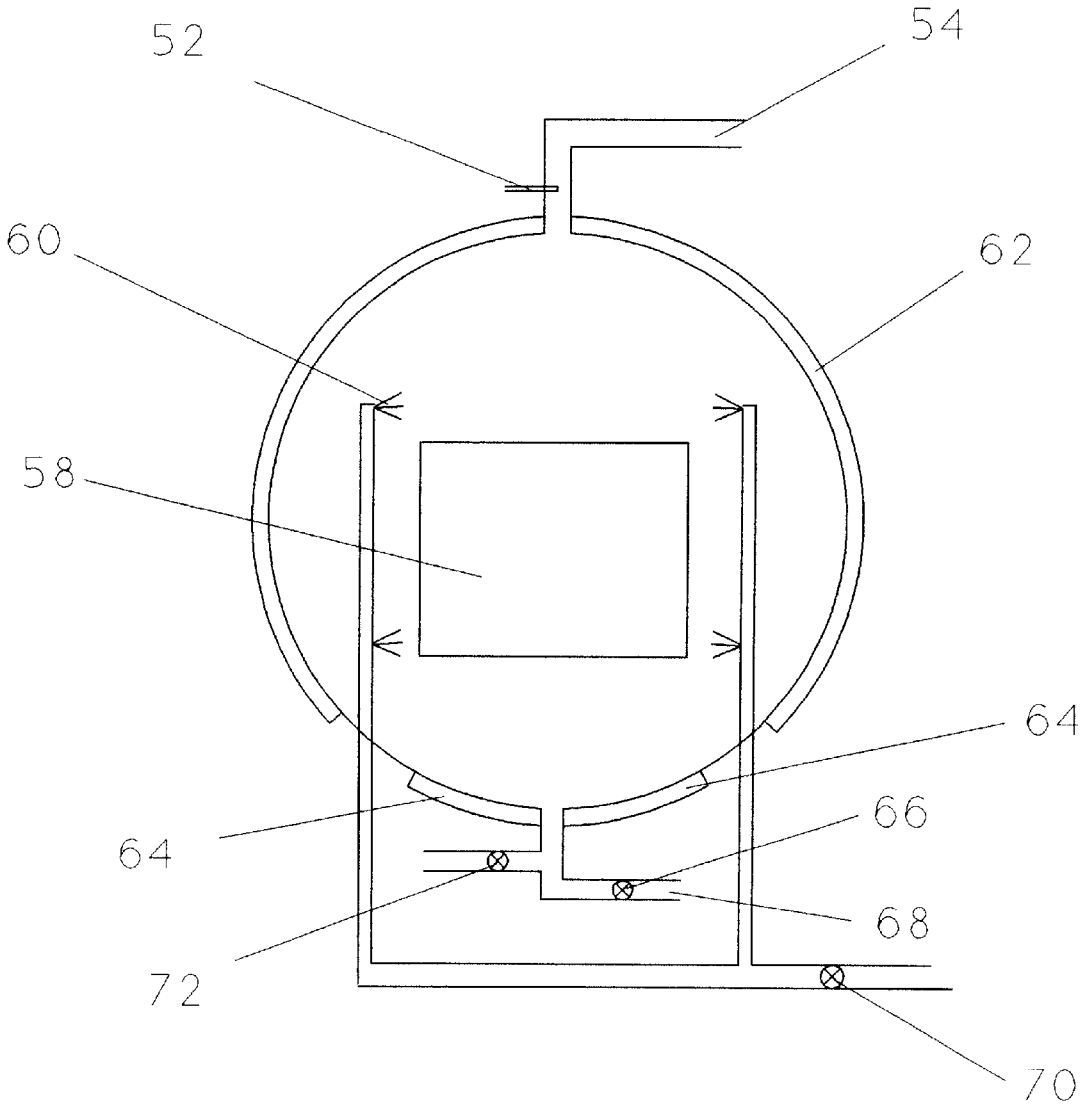
FIG. 4 is a section through FIG. 3 showing the locations of the major components if the unit.

FIG. 4 shows the section through FIG. 3. The sequencse of events are the same as the described above with either pressure or vacuum pulled on the chamber as required. The work is loaded and either a vacuum through line 54 or the chamber is purged through valve 72. The work is sprayed through valve 70 and nozzles 60. The fluid collection in the bottom of the chamber. Heat exchanger 64 is heated and the work 58 cleaned with condensing vapors. When the vapors rise to the thermocouple 52 the cleaning cycle is complete and the unloding sequence is started the system is purger with inert gas through valve 72 and into vapor recovery line 54. The spent fluid is drained through line 68 and valve 66. The work is remover and the chamber cooled down with cool liquid pumper through heat exchanger 62.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A process for vapor degreasing of parts comprising the steps of:

a. loading the parts to be degreased into an atmospheric tight chamber;

b. purging the chamber to remove any oxygen therein by means of an inert gas or by pulling a vacuum and backfilling with an inert gas;

c. introducing the degreasing fluid into the chamber and spraying the degreasing fluid over the parts in the chamber;

d. stopping the flow of degreasing fluid into the chamber when a small amount of the degreasing fluid has collected in the bottom of the chamber;

e. heating the lower part of the chamber to vaporize the degreasing fluid;

f. when the vapor level has risen to the top of the chamber, stopping the heating and draining remaining degreasing fluid from the chamber;

g. removing the vapors from the chamber by purging the chamber with an inert gas; and h. opening the chamber and removing the parts therefrom.

* * * * *